United States Patent [19]

Radford

[11] Patent Number: 4,547,978

[45] Date of Patent: Oct. 22, 1985

[54] FOOTWEAR

[75] Inventor: Alfred D. Radford, Combe, Near Langport, England

[73] Assignee: Clarks Limited, Street, England

[21] Appl. No.: 461,626

[22] Filed: Jan. 27, 1983

[30] Foreign Application Priority Data

Feb. 5, 1982 [GB] United Kingdom ..... 8203357

[51] Int. Cl.[4] ..... A43B 7/06

[52] U.S. Cl. ..... 36/3 B; 36/29

[58] Field of Search ..... 36/3 B, 3 R, 29, 59 C, 36/103, 28, 32 R, 35 R, 35 B

[56] References Cited

U.S. PATENT DOCUMENTS

| | | | |
|---|---|---|---|
| 2,090,881 | 8/1937 | Wilson | 36/29 |
| 2,553,616 | 5/1951 | Walls | 36/29 |
| 2,627,676 | 2/1953 | Hack | 36/29 |
| 4,071,963 | 2/1978 | Fukuoka | 36/3 B |
| 4,223,456 | 9/1980 | Cohen | 36/3 B |
| 4,319,412 | 3/1982 | Muller et al. | 36/59 C X |

FOREIGN PATENT DOCUMENTS

| | | | |
|---|---|---|---|
| 1007669 | 8/1953 | Fed. Rep. of Germany | 36/3 B |
| 1155947 | 7/1956 | France | 36/3 B |
| 1432811 | 2/1965 | France | 36/3 B |
| 2052268 | 3/1971 | France | 36/3 B |
| 585509 | 11/1958 | Italy | 36/3 B |
| 16240 | of 1894 | United Kingdom | 36/29 |
| 2098851 | 12/1982 | United Kingdom | 36/3 R |

*Primary Examiner*—Werner H. Schroeder
*Assistant Examiner*—T. Graveline
*Attorney, Agent, or Firm*—St. Onge Steward Johnston & Reens

[57] ABSTRACT

A boot or shoe 10 has its upper lasted to an insole 12 made from leather or a permeable plastics material, and a sole unit 13 is bonded to the lasted upper and the insole. The sole unit is moulded from a resilient plastics material and is formed with a multiplicity of cavities 15 opening to its top surface underlying the insole and open topped channels extending between the cavities. Bulges 17 are formed on the bottom surface of the sole unit at the locations of the cavities. The act of walking causes the bulges to be compressed and to pump air along the channels to others of the cavities so as to disperse perspiration from the insole. The cavities preferably have a restricted cross-sectional area 18 where they communicate with the channels.

11 Claims, 3 Drawing Figures

FOOTWEAR

This invention relates to footwear and more particularly to sole units for boots and shoes.

According to this invention there is provided a sole unit for an article of footwear which sole unit has a sole portion and a heel portion and is moulded from a resilient material, a plurality of cavities formed in the upper surface of the sole portion and heel portion of the unit, a system of channels formed in the unit, which channels interconnect the cavities, and a bulge formed on the bottom surface of the sole unit at the location of each of said cavities.

According to a preferred feature of the invention the mouth of each of the cavities has a reduced cross-sectional area where it opens to the associated channel or channels. The said reduced cross-sectional area may for example be approximately one-quarter of the maximum cross-sectional area of the cavity.

The invention also provides an article of footwear comprising an upper, a sole unit to which the upper is connected, and a porous insole or sock overlying and bonded to the top surface of the sole unit, which sole unit has a sole portion and a heel portion and is moulded from a resilient material, a plurality of cavities formed in the upper surface of the sole portion and heel portion of the unit, a system of channels formed in the unit, which channels interconnect the cavities, and a bulge formed on the bottom surface of the sole unit at the location of each of said cavities.

Figure 1:
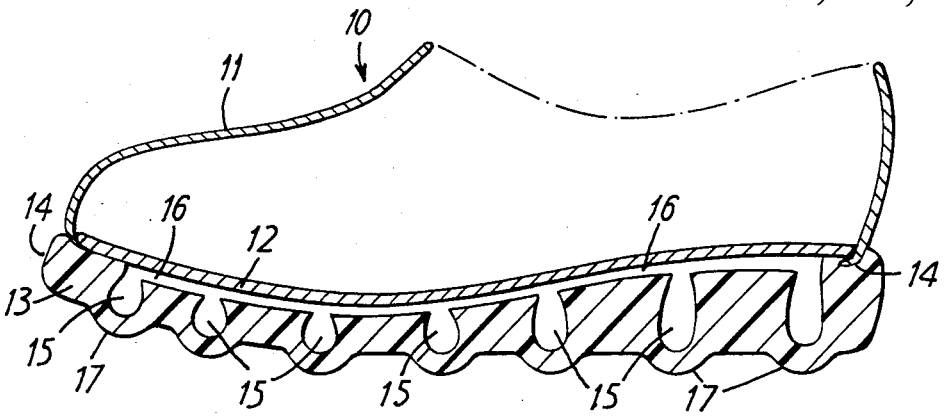
Figure 2:
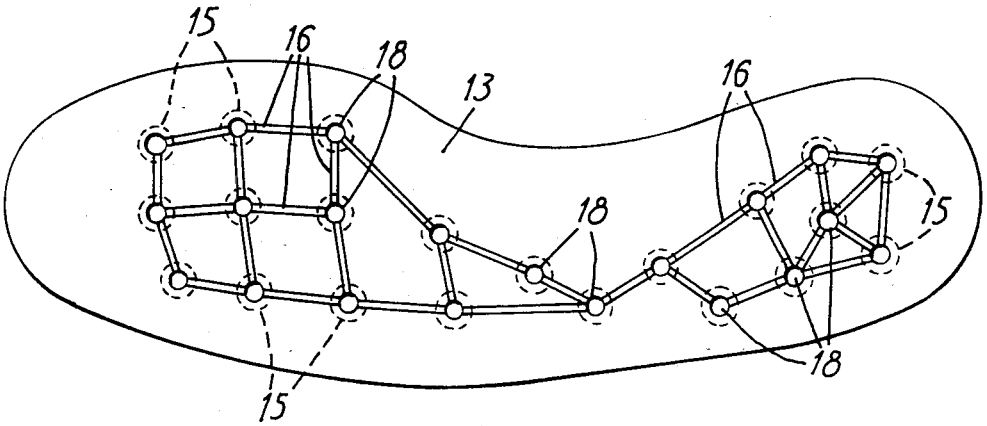
Figure 3:
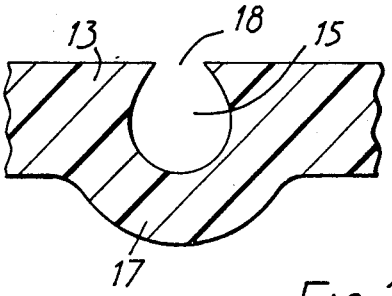

One embodiment of the invention will now be described by way of example with reference to the accompanying diagrammatic drawings in which:

FIG. 1 is a sectional view of a shoe having a sole unit according to the invention, FIG. 2 show a plan view of the sole unit of the shoe of FIG. 1, and FIG. 3 shows an enlarged view of one of the cavities.

Referring to the drawings there is shown a shoe 10 the upper 11 of which is lasted to an insole 12 made from leather, or a permeable plastics material or other suitable permeable material. A moulded sole unit 13 is bonded to the insole and lasting margin 14 of the upper.

The sole unit is moulded from a resilient plastics material such as foamed polyurethane and has a multiplicity of cavities 15 opening to the top surface of the unit and interconnected by a series of channels 16 which are also open to the top surface of the unit. The cavities are grouped chiefly in the middle of the sole area and the middle of the heel area of the unit, and at least two channels communicate with each cavity. The cavities are somewhat egg-shaped and there is a bulge 17 on the bottom surface of the sole unit at the location of each cavity, so that the pressure exerted by the foot on any bulge expels air from the associated cavity, and the action of walking pumps air from one cavity to another along the channels and in this way absorbs the shocks of impact of the foot with the ground. At the same time perspiration from the foot of the wearer can pass through the pores of the insole and be evaporated by the air flow along the channels, so that improved dispersion of the perspiration is achieved.

Each cavity has a reduced cross-section where it joins the channels so that a neck 18 is formed which tends to restrict the rate of flow of air into and out of the cavities. In the illustrated construction the diameter of the cavity at the neck is approximately half of the maximum diameter of the cavity. The maximum diameter is typically in the range 8 to 12 mm.

The bulges on the underside of the sole unit may have a height of 6 to 8 mm.

I claim:

1. A sole unit for an article of footwear, which sole unit is formed in one piece from a resilient moldable material, comprising: a sole portion and a heel portion molded integrally with each other and having top and bottom surfaces, a plurality of cavities formed in each of said portions, a system of channels formed in the top surface of said portions, each of said cavities having a restricted opening through which the cavity is individually in communication with the system of channels, a bulge formed on the bottom surface below each of said cavities wherein the cross-sectional area of said restricted opening is substantially one-quarter of the maximum cross-sectional area of the cavity, and wherein the maximum diameter of the cavities is in the range 8 to 12 mm.

2. A sole unit as claimed in claim 1, wherein a multiplicity of said cavities are provided and include concentrations in the sole portion and in the heel portion.

3. A sole unit as claimed in claim 1, wherein each of said cavities has at least two channels of the channel system connected thereto.

4. A sole unit as claimed in claim 1, wherein the bulges on the bottom surface have a height in the range 6 to 8 mm.

5. A sole unit as claimed in claim 1 wherein a majority of the cavities has at least three channels of the system of channels connected thereto.

6. A sole unit as claimed in claim 1 wherein the system of channels interconnecting the cavities includes channels directed substantially laterally as well as longitudinally.

7. A sole unit as claimed in claim 1 wherein the cavities are egg-shaped.

8. A sole unit for an article of footwear, which sole unit is formed in one piece from a resilient moldable material, comprising: a sole portion and a heel portion molded integrally with each other and having top and bottom surfaces, a plurality of cavities formed in each of said portions, a system of channels formed in the top surface of said portions, each of said cavities having a restricted opening through which the cavity is individually in communication with the system of channels, a bulge formed on the bottom surface below each of said cavities wherein the cross-sectional area of said restricted opening is substantially one-quarter of the maximum cross-sectional area of the cavity, and wherein the bulges on the bottom surface have a height in the range 6 to 8 mm.

9. An article as claimed in claim 8, wherein a multiplicity of said cavities are provided and include concentrations in the sole portion and in the heel portion of the sole unit.

10. An article as claimed in claim 8, wherein each of said cavities has at least two channels of the channel system connected thereto.

11. An article as claimed in claim 8, wherein the bulges on the bottom surface of the sole unit have a height in the range 6 to 8 mm.

* * * * *